US012759835B2

(12) United States Patent
Sauret et al.

(10) Patent No.: US 12,759,835 B2
(45) **Date of Patent: *Oct. 13, 2026**

(54) SELF-SYNCHRONIZING YARN TENSION MONITORING AND CONTROL SYSTEM

(71) Applicant: ELTEX OF SWEDEN AB, Osby (SE)

(72) Inventors: Daniel Sauret, Barcelona (ES); Alex Martinez, Barcelona (ES); Jonas Hansson, Osby (SE); Brian Hicks, Osby (SE)

(73) Assignee: ELTEX OF SWEDEN AB, Osby (SE)

( * ) Notice: Subject to any disclaimer, the term of this patent is extended or adjusted under 35 U.S.C. 154(b) by 188 days.

This patent is subject to a terminal disclaimer.

(21) Appl. No.: 18/733,929

(22) Filed: Jun. 5, 2024

(65) Prior Publication Data

US 2024/0409358 A1 Dec. 12, 2024

(30) Foreign Application Priority Data

Jun. 7, 2023 (EP) ..... 23382558

(51) Int. Cl.
*B65H 59/38* (2006.01)

(52) U.S. Cl.
CPC ..... *B65H 59/384* (2013.01); *B65H 2513/20* (2013.01); *B65H 2515/31* (2013.01); *B65H 2701/31* (2013.01)

(58) Field of Classification Search
CPC ..... B65H 59/22; B65H 59/38; B65H 59/40; B65H 59/384
See application file for complete search history.

(56) References Cited

U.S. PATENT DOCUMENTS 4,768,728 A * 9/1988 Jenny ..... B65H 61/00 242/414.1
2005/0173579 A1* 8/2005 Barea ..... D04B 15/50 242/365.7

(Continued)

FOREIGN PATENT DOCUMENTS

EP 0619261 A1 10/1994

OTHER PUBLICATIONS

Extended European Search Report for Application No. EP 23382560.3, mailed Dec. 19, 2023, 9 pages.

*Primary Examiner* — Sang K Kim
(74) *Attorney, Agent, or Firm* — Dority & Manning, P.A.

(57) ABSTRACT

A self-synchronizing yarn tension control system is provided. Self-synchronizing yarn tension control includes a yarn tension sensor, a yarn brake, and a controller configured to control the system. The controller includes one or more processors and one or more memory devices. The memory devices configured to store the more memory devices configured to store one or more tension pulses, store one or more tension thresholds, and store instructions that when executed by the processors cause the processors to perform operations. The operations include obtaining a first yarn tension value and selectively operating the yarn brake based on the tension pulses. Obtaining a second yarn tension value by operating the yarn brake based on the tension pulses. Determining whether the first tension value exceeds the second tension value. Obtaining a yarn tension signal from the yarn tension sensor, comparing the yarn tension signal to the one or more tension thresholds, generating one or more brake control signals based on said comparison and operating the yarn brake based upon each of the one or more brake signals.

15 Claims, 3 Drawing Sheets

(56) References Cited

U.S. PATENT DOCUMENTS

| | | | | |
|---|---|---|---|---|
| 2013/0056573 | A1 | 3/2013 | Barea | |
| 2020/0340972 | A1* | 10/2020 | Huthmacher | B65H 63/02 |
| 2021/0122604 | A1* | 4/2021 | Huthmacher | B65H 63/02 |
| 2021/0188590 | A1* | 6/2021 | Huthmacher | G01L 5/10 |
| 2024/0409357 | A1* | 12/2024 | Sauret | B65H 59/40 |

* cited by examiner

SELF-SYNCHRONIZING YARN TENSION MONITORING AND CONTROL SYSTEM

FIELD

The present disclosure relates generally to systems and methods for yarn tension control for textile machines and, more particularly, to a method and system for self-synchronizing yarn tension control. The method and system for yarn tension monitoring and control that is the subject of the present disclosure relates to facilitating yarn tensioning on textile machines such that it is self-synchronizing with the textile machine based on yarn tension caused by the operation of the textile machine, wherein such yarn tension is based on tensioning pulses and selectively operating a yarn brake based on the tensioning pulses.

BACKGROUND

Textile machines utilize threads, textile yarns, fibers, metal or metal wire, and the like, made of natural or synthetic materials, which are referred to collectively hereinafter as yarn(s), to produce, fabricate or process various textile products, such as fabric, rugs, carpeting or the like, referred to collectively herein as "textile products." Yarn used by textile machines to produce or create textile products is fed or introduced into the textile machine. Efficient and proper operation of a textile machine is dependent, at least in part, on the tension applied to and maintained on the yarn being fed into a textile machine. Applying or maintaining a consistent tension or applying tension to yarn within an appropriate tension range, allows yarn to be properly fed into a textile machine thereby allowing the textile machine to run more efficiently. Appropriate yarn tension also reduces operational errors or inconsistencies in the textile machine thereby permitting the textile machine to produce a textile product of improved quality and consistent quality. Appropriate yarn tension also reduces yarn breaks and thus, increases production by reducing downtime.

For these reasons, it is advantageous to monitor and control certain aspects or conditions of the yarn being fed into a textile machine. For example, the occurrence of defects in a textile product can be reduced or minimized by monitoring and controlling the yarn fed into a textile machine while the machine is operational, such that the yarn is supplied at a particular or consistent rate, at a particular or constant tension and/or at a certain speed. Monitoring and controlling the tension of yarn being fed into a textile machine while it is operational is significant to the manufacture of textile products and will reduce of minimize occurrence of defects in a textile product produced by a textile machine.

Existing approaches to yarn tension monitoring for textile machines can present certain challenges. For instance, textile machines that are manufactured are not uniform in their design or operation (e.g., textile machines can have different manufactures, including different features, incompatible designs, new or outdated technology or numerous other distinct aspects). As a result, textile machines that may include integral yarn tension monitoring features and systems do not utilize a consistent yarn tension monitoring system or method for yarn tension monitoring. Therefore, numerous different yarn tension monitoring systems can be used on various textile machines within the same manufacturing facility or by a user (e.g., company or plant), which can complicate installation, operation, maintenance, and repair of the textile machines because personnel must be able to operate and service numerous systems or spare parts for numerous types of machines must be maintained or sourced.

Additionally, some textile machines that remain in use may have been manufactured before yarn tension monitoring systems were developed or available. As a result, the incorporation or addition of yarn tension monitoring systems into existing textile machines or textile machines that were not originally designed with or include a yarn tension monitoring system, can have drawbacks including limitations on and complications associated with the compatibility of a tension monitoring system with the control system of the textile machine. To promote the proper, efficient and reliable functioning, the operation of a yarn tension monitoring system should synchronize with the operation of the textile machine. In some instances, existing textile machines may have control systems that do not permit the addition of a tension monitoring system. In other instances, the control systems for existing textile machines are locked or otherwise prohibit communication with an added yarn tension monitoring system (e.g., control systems for existing textile machines may not include a signal output or interface to facilitate communication with an added yarn tension monitoring system). The challenges associated with these control systems can prevent an added tension monitoring system from properly synchronizing or remaining synchronized with the operations of an existing textile machine. If the operations of a textile machine and yarn tension monitoring system are not synchronized, both at start-up and throughout operation, both the textile machine and yarn tension monitoring system can operate improperly and cause errors, such as false yarn breakage errors, improper textile machine shutdowns, or poorly constructed textile products.

Even if a yarn tension monitoring system can be added to an existing textile machine or textile machine that did not originally include or was not originally designed with a yarn tension monitoring system, the complex process of integrating or adding a yarn tension monitoring system into a control system for an existing textile machine has the drawback of increasing the cost and manufacturing facility down time associated with the complexity of integrating the control system of the textile machine with a yarn tension monitoring system. Such integration often requires reprogramming of an existing textile machine so that the textile machine and yarn tension monitoring system operate together, and the operations are synchronized. The necessary reprogramming of the control system for the existing textile machine to incorporate the addition of a yarn tension monitoring system can increase down time of the textile machine and the manufacturing facility due to the time associated with adding a yarn tension monitoring system to an existing textile machine.

The incorporation of yarn tension monitoring systems to existing textile machines can add complexity to the programming of the control system for the textile machine which can cause operational errors based on programming errors or conflicts between the programming languages. As such, reliability or functionality of the textile machine and yarn tension monitoring system can be negatively impacted. For example, the effectiveness of the yarn tension monitoring system and/or textile machine can be reduced by, e.g., false yarn breakage, improper tension measurements or tension alarms, which can cause the textile machine to stop operating or result in defects in textile products due to improper yarn tensioning.

Accordingly, a self-synchronizing yarn tensioning monitoring and control system for textile machines with features that address one or more of the challenges noted above would be useful and welcomed.

BRIEF DESCRIPTION

Aspects and advantages of embodiments of the present disclosure will be set forth in part in the following description, or may be learned from the description, or may be learned through practice of the embodiments.

One example aspect of the present disclosure is directed to a self-synchronizing yarn tension control system facilitating necessary yarn tensioning on textile machines based on yarn tension caused by the operation of the textile machine based on tensioning pulses and without connection to or communication with the control-unit of the textile machine. The self-synchronizing yarn tension control system can include a yarn tension sensor, a yarn brake, and a controller. The controller is configured to control the system. The controller includes, one or more processors and one or more memory devices, the one or more memory devices configured to store the one or more tension thresholds and store instructions that when executed by the one or more processors cause the one or more processors to perform operations. The operations can include obtaining a first yarn tension value based on the yarn tension sensor. The operations can also include generating one or more tensioning pulses, wherein the controller selectively operates the yarn brake based on the one or more tensioning pulses. The operations include obtaining a second yarn tension value based on the yarn tension sensor, comparing the first yarn tension value to the second yard tension value, determining whether a textile machine is operational based on the comparison of the first yarn tension value and the second yarn tension value. The operations can further include ceasing operation of the yarn brake based on the one or more tensioning pulses when the second yarn tension value exceeds the first yarn tension value. The operations can further include, obtaining a yarn tension signal from the yarn tension sensor, comparing the yarn tension signal to the one or more tension thresholds, generating one or more brake control signals based on said comparison of the yarn tension signal to the one or more tension thresholds, and operating the yarn brake based upon each of the one or more brake signals. The controller of the self-synchronizing yarn tension system is not in communication with the textile machine or controller of said textile machine.

In some example embodiments of the self-synchronizing yarn tension system, the one or more tension thresholds of the system comprise a high tension threshold and a low tension threshold, which define a tension range. In some embodiments comparing the yarn tension signal to the one or more tension thresholds can include comparing yarn tension signal to the tension range, comparing yarn tension signal to the low tension threshold, and comparing yarn tension signal to the high tension threshold.

The self-synchronizing yarn tension system can also operate the yarn brake based upon each of the one or more brake signals by increasing the yarn brake pressure, based on a braking increment, in response to determining the yarn tension signal is below the low-tension threshold. Operating the yarn brake can include decreasing the yarn brake pressure, based on a braking increment, in response to determining the yarn tension signal is above the high-tension threshold. The braking increment can be based, at least in part, on a type of yarn being utilized by the textile machine.

The system controller can determine whether the textile machine is not operational based on the comparison of the yarn tension signal to the low tension threshold. In response to determining the textile machine is not operational, controller can generate a stop signal, generating an alarm signal and/or operating the controller and the yarn brake based on the stop signal. In response to the stop signal controller can selectively operate the yarn brake based on the one or more tensioning pulses.

Another exemplary embodiment of the present disclosure is directed to a method for yarn tension control through a stand-alone self-synchronizing system. The stand-alone self-synchronizing system includes one or more controllers, a yarn brake, a yarn tension sensor, and a yarn brake. The method includes obtaining a first yarn tension value, operating the yarn brake based on one or more tension pulses and obtaining a second yarn tension value by selectively operating the yarn brake based on the one or more tension pulses. The method also includes determining whether the first tension value exceeds the second tension value and obtaining a yarn tension signal from the yarn tension sensor. The method can also include comparing the yarn tension signal to the one or more tension thresholds, generating one or more brake control signals based on said comparison, and operating the yarn brake based upon each of the one or more brake signals.

Variations and modifications can be made to these example aspects of the present disclosure. These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
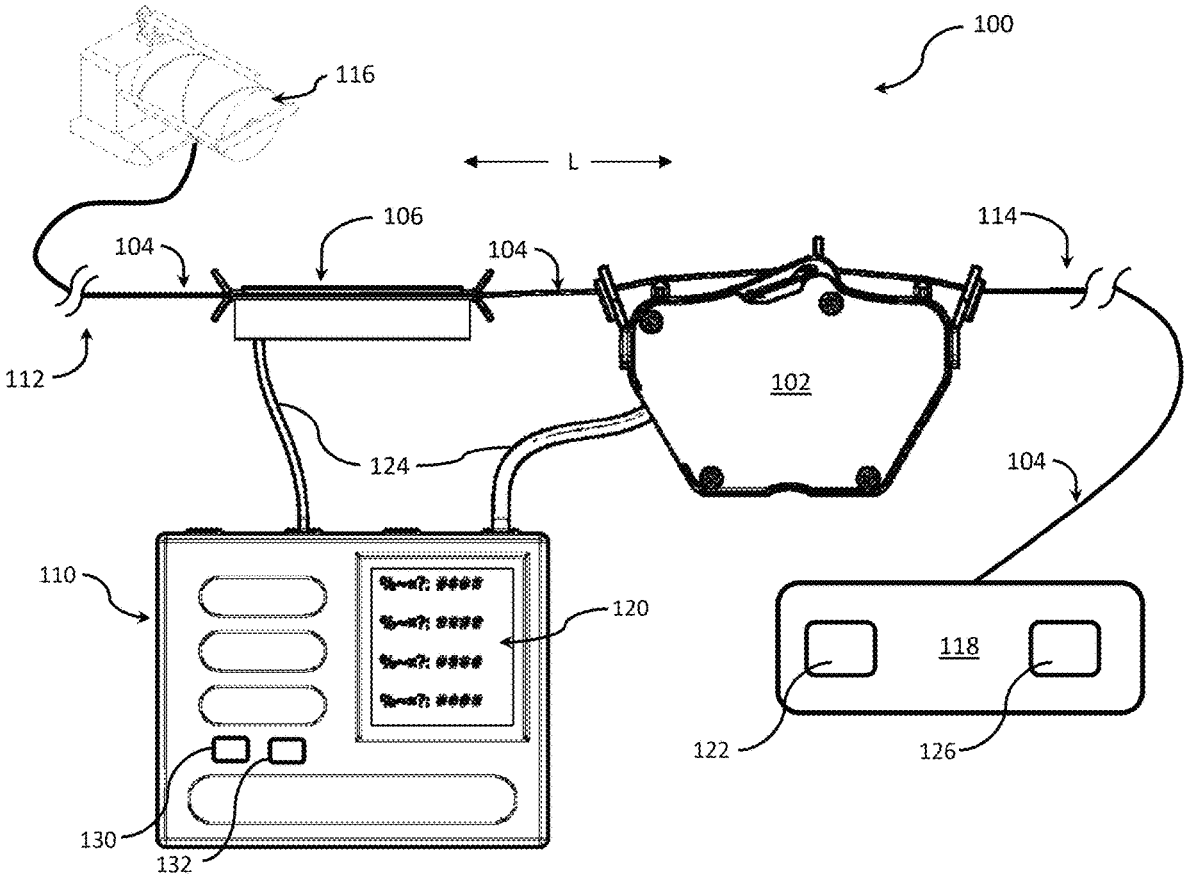
FIG. 1 depicts a self-synchronizing yarn tension control system according to exemplary embodiments of the present disclosure.

Repeat use of reference characters in the present specification and drawings is intended to represent the same or analogous features or elements of the present disclosure.

DETAILED DESCRIPTION

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The singular forms "a", "an", and "the" include plural references unless the context clearly dictates otherwise. As used herein, terms of approximation, such as "approximately," "substantially," or "about," refer to being within a ten percent margin of error.

Aspects of the present disclosure are directed to systems and methods for self-synchronizing yarn tension for textile machines. The systems and methods for self-synchronizing yarn tension for textile machines of the present disclosure can monitor and control yarn tension and synchronize the operation(s) of the self-synchronizing yarn tension system with the operation(s) of the textile machines.

The systems and methods for self-synchronizing yarn tension monitoring and control of the present disclosure can be added to or incorporated to textile machines without connection to or interface with the control unit or control system of the textile machine (e.g., textile machine control unit 122). In this way, the systems and methods of the present disclosure can execute or provide self-synchronizing yarn tension monitoring and control for a textile machine (e.g., textile machine 118) without receiving a command, signal, output or other instruction from textile machine control unit 122 and without being in electrical communication with the control system, controller, or computer operating or controlling the textile machine (e.g., control unit 122). Stated differently, the self-synchronizing yarn tension system of the present disclosure operates autonomously without direct connection to the control unit (e.g., control unit 122) of the textile machine (e.g., textile machine 118).

Referring now to the figures, example aspects of the present disclosure will be discussed in greater detail.

FIG. 1 depicts a self-synchronizing yarn tension system 100 according to exemplary embodiments of the present disclosure. The self-synchronizing yarn tension system 100 can be utilized on any textile machine 118 where yarn is fed from a yarn source 116, such as a bobbin, spool or other yarn storage or dispensing device, into a textile machine 118 for use in manufacturing textile products. The textile machine 118 in FIG. 1 can be any known textile machine that utilizes threads, textile yarns, fibers, and the like to produce, fabricate or process various textile products, such as fabric, rugs, carpeting or the like. In this regard the textile machine 118, with which the self-synchronizing yarn tension system 100 can be used, is any known textile machine utilizing yarn to manufacture textile products.

The embodiment of the self-synchronizing yarn tension system 100 depicted in FIG. 1 includes a yarn brake 106, a yarn tension sensor 102, a controller 110, and a plurality of control or signal cables 124.

In some exemplary embodiments of the present disclosure, the self-synchronizing yarn tension system 100 can include a yarn tension sensor 102, can generate a first yarn tension value (601) and transmit the first yarn tension value (601) to the controller 110. In response to the controller 110 receiving a first yarn tension value (601) from yarn tension sensor 102, the controller 110 can perform operations such as generating one or more tension pulses (602). First yarn tension value (601) can be a predetermined value stored in one or more memory devices 130 of the controller 110. For example, first yarn tension value could be about 0 to 5 cN, or another tension amount or value entered in the controller 110 by a user or operator through a graphical user interface 120 (e.g., a touch screen) or other input devices (e.g., keyboard, buttons, etc.) that is part of or in communication with the controller 110 and said user input(s) are stored in the one or more memory devices 130 of the controller 110. In other embodiments, first yarn tension value could be the yarn 104 tension measured by tension sensor 102 by sensing element 202 of tension sensor 102 at a particular time (e.g., such as 0 cN or such as when system 100 is initially turned on or energized).

The one or more tension pulses (602) can be signals which control operation of yarn brake 106. For example, tension pulses (602) can be a predetermined or user selected increment of pressure or tension that the yarn brake 106 applies to the yarn 104 passing through yarn brake 106.

The controller 110 can include one or more processors 132 and one or more memory devices 130, the one or more memory devices 130 configured to store the one or more tension pulses and store instructions that when executed by the one or more processors 132 cause the one or more processors 132 to perform operations. The one or more tension pulses (i.e., tension pulses 602) can be entered in the controller 110 by a user or operator through a graphical user interface 120 (e.g., a touch screen) or other input devices (e.g., keyboard, buttons, etc.) that is part of or in communication with the controller 110 and said user input(s) are stored in the one or more memory devices 130 of the controller 110. The tension pulses can also be pre-determined values, stored or programmed into the one or more memory devices 130 by, e.g., the manufacturer of the self-synchronizing yarn tension system 100. For example, tension pulses could be of a predetermined value of 10 cN for a period of 10 milliseconds or any other value of force and time. Said tension pulses can be based on the type of yarn 104 or type of textile machine 118 with which the self-synchronizing yarn tension system 100 is being used. The tension pulses represent a specific amount of tension that is added or removed from the yarn 104 by the yarn brake 106 at a set interval of time (e.g., 10 milliseconds, so the yarn brake 106 is pulsed), in order to detect a change in tension in the yarn 104 at the yarn feed side 114 of the self-synchronizing yarn tension system 100. The one or more processors 132 of controller 110 can store instructions that when executed by the one or more processors 132 to selectively operate the yarn brake 106 based on the one or more tension pulses (60).

The operations performed by processors 132 of controller 110 can also include obtaining a second yarn tension value (603) based on or from the yarn tension sensor 102. The second yarn tension value (603) represents the yarn 104 tension measured by tension sensor 102 by sensing element 202 of tension sensor 102 after controller 110 selectively operates (pulses) yarn brake 106 based on the one or more tension pulses (602).

The operations performed by processors 132 of controller 110 can also comparing the first yarn tension value (601) to the second yard tension value (603), determining whether a textile machine is operational based on the comparison of the first yarn tension value (601) and the second yarn tension value (603). More specifically, if second yarn tension value (603) is higher than first yarn tension value (601) the comparison is indicative of the textile machine 118 being in an operational state (i.e., the textile machine 118 is running and yarn 104 is moving in a lateral direction L from the yarn supply side 112 to the yarn feed side 114 of the self-synchronizing yarn tension system 100).

If the second yarn tension value (603) does not exceed the first yarn tension value (601) the comparison is indicative of the textile machine 118 not being in an operational state (i.e., the textile machine 118 is not running and yarn 104 is not moving in a lateral direction L from the yarn supply side 112 to the yarn feed side 114 of the self-synchronizing yarn tension system 100) and the operations performed by processors 132 of controller 110 can continue to be to selectively operate the yarn brake 106 based on the one or more tension pulses (602).

The operations performed by processors 132 of controller 110 can also include obtaining a yarn tension signal (607) from the yarn tension sensor 102, comparing the yarn tension signal (607) to the one or more tension thresholds (e.g., low tension threshold 608 and high tension threshold 610), generating one or more brake control signals (612) based on said comparison of the yarn tension signal to the one or more tension thresholds, and operating the yarn brake 106 based upon each of the one or more brake signals (612). The controller of the self-synchronizing yarn tension system 100 is not in communication with controller 122 of the textile machine.

In response to the controller 110 determining the second yarn tension value (603) is higher, greater than or exceeds first yarn tension value (601), the controller 110 can perform additional operations to such that the yarn 104 has or maintains an appropriate or designated yarn tension on the yarn feed side 114 of the yarn tension system 100. The operations can include obtaining a yarn tension signal (607) from tension sensor 102. Yarn tension signal (607) represents the yarn 104 tension measured by tension sensor 102 by sensing element 202 of tension sensor 102 when the textile machine 118 is in an operational state (i.e., the textile machine 118 is running and yarn 104 is moving in a lateral direction L from the yarn supply side 112 to the yarn feed side 114 of the self-synchronizing yarn tension system 100).

The controller 110 and processors 132 can perform additional operations. The operations can include comparing yarn tension signal to a yarn tension range (607), comparing yarn tension signal (607) to one or more tension thresholds, generating a brake control signal (612) based on said comparisons and operating yarn brake 106 based on said brake control signal (612).

The one or more tension thresholds (i.e., low tension threshold 608 or high tension threshold 610) or a tension target point can be entered in the controller 110 by a user or operator through a graphical user interface 120 (e.g., a touch screen) or other input devices (e.g., keyboard, buttons, etc.) that is part of or in communication with the controller 110 and said user input(s) are stored in the one or more memory devices 130 of the controller 110. The tension thresholds or tension target point can also be pre-determined values, stored or programmed into the one or more memory devices 130 by, e.g., the manufacturer of the self-synchronizing yarn tension system 100. Said tension thresholds or tension target point can be based on the type of yarn 104 or type of textile machine 118 with which the self-synchronizing yarn tension system 100 is being used. The tension target point represents a specific amount of tension that is required or desired on the yarn 104 at the yarn feed side 114 of the self-synchronizing yarn tension system 100.

As discussed further herein, controller 110, can also generate other signals, such as an alarm signal (616). The alarm signal (616) can be a visual, auditory, or other type of indicator which informs a user or operator of an operational condition of textile machine 118. In response to the alarm signal (616), the controller 110 can perform other operations such as, setting the brake 106 to a predetermined, or setting the brake 106 in resting position, or deenergizing or turn-off elements of the self-synchronizing yarn tension system 100 which are not needed to allow tension sensor 102 to generate a second yarn tension value (603) or to allow controller 110 to selectively operate yarn brake 106 based on the tension pulses (602).

It should be appreciated that the present disclosure is not limited to any particular style, model, or configuration of controller 110, yarn brake 106, or tension sensor 102. The yarn brake 106 depicted in FIG. 1 is an electromechanical flap brake. However, the yarn brake 106 utilized with the self-synchronizing yarn tension system 100 can be a different type or configuration of brake that is configured to apply force or tension to the yarn 104 that is passing through or in physical communication with the yarn brake 106.

The exemplary embodiment depicted in the figures is for illustrative purposes only. For example, different locations may be provided for the controller 110, and different configurations may be provided for the graphical user interface 120 of self-synchronizing yarn tension system 100. Furthermore, it should be appreciated that different sensor types may be used in place of tension sensor 102 depicted in FIG. 1 (such as a combination movement and tension sensor). For example, a single combination sensor could be used in place of yarn tension sensor 102, which has numerous functions including movement detection functions and tension detection functions.

The self-synchronizing yarn tension system 100 of FIG. 1 includes a yarn supply side 112 and a yarn feed side 114. The yarn supply side 112 represents the direction or location from which yarn 104 is drawn into the self-synchronizing yarn tension system 100 from a yarn source 116. The yarn source 116 can be any known yarn storage device used with textile machines, such as a bobbin or spool. The yarn feed side 114 represents the direction or location from which yarn 104 is supplied to the textile machine 118 or the direction from which yarn 104 is drawn through the self-synchronizing yarn tension system 100 and fed to a textile machine 118, where the yarn 104 will be utilized the manufacture a textile product.

It should be appreciated that while one self-synchronizing yarn tension system 100 is depicted in FIG. 1, a plurality of self-synchronizing yarn tension systems 100 may be used with a textile machine 118, wherein the textile machine 118 utilizes a plurality of strands of yarn 104 to manufacture textile products. For example, a self-synchronizing yarn tension system 100 can be used with each of the plurality of strands of yarn 104. Use of a separate self-synchronizing yarn tension system 100 for each strand of yarn 104 being fed to the textile machine 118 is advantageous because all yarn sources 116 are not wound or created with the same or a consistent tension on the yarn as stored on the yarn source 116 (e.g., yarn may not be wrapped or wound as tightly on different bobbins or spools). Similarly, as a yarn 104 is used from a yarn source 116 (e.g., removed from bobbins or spools and used by the textile machine 118 to produce a textile product) the amount of tension in the yarn source 116 can change. Therefore, all strands of yarn 104 in a textile machine may not have a consistent tension at the yarn supply side 112 of each of the separate self-synchronizing yarn tension systems 100 when the yarn 104 is being drawn or pulled from a yarn source 116 for use in an operating textile machine 118.

Therefore, each strand of yarn 104 will reach each of the plurality of separate self-synchronizing yarn tension systems 100 at the yarn supply side 112 with a different tension. In this way each of the separate self-synchronizing yarn tension systems 100 for each strand of yarn 104 being fed to the textile machine 118 can apply a consistent tension to the yarn 104 at the yarn feed side 114 of each of the separate self-synchronizing yarn tension systems 100.

The operations of the controller 110 can further include ceasing operation of the yarn brake 106 based on the one or more tensioning pulses (602) when the second yarn tension (603) value exceeds the first yarn tension value (601). The yarn tension sensor 102 can detect tension of the yarn 104. When the tension sensor 102 generates a tension signal (607) which is obtained by the controller 110, the tension signal (607) is indicative of the textile machine 118 being in an operational state (i.e., the textile machine 118 is running and yarn 104 is moving in a lateral direction L from the yarn supply side 112 to the yarn feed side 114 of the self-synchronizing yarn tension system 100). Such tension signal (607) is created or generated by sensor 102 without connection to or being in communication with the control-unit 122 of the textile machine 118. Control-unit 122 can include one or more processors and one or more memory devices 126, the one or more memory devices 126 configured to store instructions that when executed by the one or more processors cause the one or more processors to perform operations causing the textile machine 118 to function, run or otherwise operate.

The systems and methods for self-synchronizing yarn tension of the present disclosure can provide yarn tension monitoring and control functions based, at least in part, on the detection of yarn tension. The self-synchronizing yarn tension system 100 can detect the operation of textile machine 118 based on yarn tension signal (607). For example, the self-synchronizing yarn tension system 100 includes a yarn tension sensor 102 which can detect tension of yarn 104 which is drawn from a yarn source 116 (e.g., a bobbin or spool) and fed into a textile machine 118 for use in the production or manufacture of a textile product. The yarn tension sensor 102 can detect movement of the yarn and based on the detection of yarn tension at sensing element 202.

The yarn tension sensor 102 can detect or monitor yarn tension on a continuous, real-time basis or at one or more monitoring intervals. The monitoring intervals can be predetermined periods of time (e.g., between 10 and 100 milliseconds) that are stored in one or more memory devices 130 of the controller 110. The monitoring interval can also be one or more increments of time entered into controller 110 by a user or operator through a graphical user interface 120 or other input devices (e.g., keyboard, button(s), mouse, etc.) that is part of or in communication with the controller 110 and stored in the one or more memory devices 130 of the controller 110. The graphical user interface 120 depicted in FIG. 1 is a touch screen, however it should be appreciated that other user input or user interfaces can be utilized. The monitoring interval(s) represent(s) the frequency at which or time intervals at which the yarn tension sensor 102 detects or monitor for yarn tension, generates a yarn tension signal, and said yarn tension signal is received by the controller 110. The yarn tension signal is received by the controller 110 through one or more communication cables 124.

Communication cables 124 can be various electrical conductors, wires, and cables, such as coaxial cable or M8 sensor cable. While certain cables, pins, connectors, conductors, and coaxial cable may be discussed as being compatible with respect to certain example embodiments of the present disclosure, it will be appreciated by those of skill in the art that other electrical conductors, wires, or cables may be utilized to interconnect sensors, controllers, and other devices of the present disclosure. It will also be appreciated that communication between controller 110, yarn tension sensor 102 and yarn brake 106, does not necessarily require communication cables 124, but could be accomplished by other known means such as with any suitable wired or wireless communications network for communicating data by and between components and/or other components or systems not depicted. For example, controller 110 could utilize a wireless communication network to communicate data with other components, including the yarn tension sensor 102 and yarn brake 106.

In some embodiments, self-synchronizing yarn tension system 100 controller 110 can regulate operation of the components of self-synchronizing yarn tension system 100. Controller 110 may include one or more memory devices 130 and one or more microprocessors 132, such as general or special purpose microprocessors operable to execute programming instructions or micro-control code associated with a tension monitoring cycle as described in FIG. 3. The memory may represent random access memory RAM or read only memory such as ROM or FLASH. In one embodiment, the processor executes programming instructions stored in memory. For certain embodiments, the instructions include a software package configured to operate system 100 and, for example, execute the commands associated with the control method referenced in FIG. 3. For certain embodiments, data can be communicated to or from controller 100 in order to control operation of self-synchronizing yarn tension system 100, including brake 106, and tension sensor 102. The memory 130 may be a separate component from the processor 132 or may be included onboard within the processor 132.

Input/output ("I/O") signals may be routed between the controller 110 and various operational components (e.g., brake 106, tension sensor 102) of self-synchronizing yarn tension system 100 along one or more wiring harnesses or cables 124 that may be routed through the self-synchronizing yarn tension system 100.

Optionally, the controller 110 includes a user interface 120 through which a user may select various operational features and modes and monitor progress of the self-synchronizing yarn tension system 100. In exemplary embodiments, the user interface 120 may represent a general purpose I/O ("GPIO") device or functional block. For instance, the user interface 120 may include input components, such as one or more of a variety of electrical, mechanical, or electro-mechanical input devices including rotary dials, push buttons, and touch pads. The user interface 120 may include a display component, such as a digital or analog display device designed to provide visual operational feedback to a user. Additionally or alternatively, the user interface 120 may include one or more feedback devices (e.g., audio or visual devices such as speakers or lights, or other devices capable of providing a signal to a user) designed to provide operational feedback to a user. The user interface 120 may be in communication with the controller 110 via one or more signal lines or shared communication buses. In some embodiments, the user interface 120 is configured to receive one or more alert signals from the controller 110 and, in turn, generate a visual or audio alert response (e.g., at the display device or audio device of the user interface 120).

In additional or alternative embodiments, controller 110 is configured to operably communicate (e.g., wirelessly communicate) with one or more user devices (not pictured), such as a general purpose computer, special purpose computer, laptop, desktop, integrated circuit, mobile device, smartphone, tablet, or other suitable computing device. For instance, controller 110 may be in wireless communication with a user device via a suitable wireless network; such as a local area network (e.g., intranet), wide area network (e.g., internet), low power wireless networks [e.g., Bluetooth Low Energy (BLE)], or some combination thereof and can include any number of wired or wireless links. In general, communication over the network can be carried via any type of wired or wireless connection, using a wide variety of communication protocols (e.g., TCP/IP, HTTP, SMTP, FTP, CAN, LIN RS, IIC, SPI or other know protocols), encodings or formats (e.g., HTML, XML), or protection schemes (e.g., VPN, secure HTTP, SSL).

The yarn tension thresholds (608 and 610) can be a low-tension threshold 608 and a high-tension threshold 610 which form a yarn tension range 606. The low-tension threshold 608 represents the least amount of tension that can be applied to yarn 104 located on the yarn feed side 114 of the self-synchronizing yarn tension system 100. The high-tension threshold 610 represents the highest amount of tension that can be applied to the yarn 104 located on the yarn feed side 114 of the self-synchronizing yarn tension system 100. In some embodiments, the high-tension threshold 610 can represent the amount of tension above which the yarn 104 is likely to break, fray or otherwise become damaged. In some exemplary embodiments of the present disclosure the yarn tension range 606 represents a plurality of values representing the appropriate tension amounts that must be maintained on the yarn 104 located on the yarn feed side 114 of the self-synchronizing yarn tension system 100, to allow for the yarn 104 that is fed into the textile machine 118 to be maintained at an appropriate tension to produce the most efficient and proper operation of the textile machine 118 and produce the highest quality textiles as is possible by said textile machine 118. In other exemplary embodiments, yarn tension range 606 represents a tension target point which is a singular set value (within an approximate range of error such as 10%) representing the appropriate, desired or set tension amount that must be maintained on the yarn 104 located on the yarn feed side 114 of the self-synchronizing yarn tension system 100, to allow for the yarn 104 that is fed into the textile machine 118 to be maintained at an appropriate tension to produce the most efficient and proper operation of the textile machine 118 and produce the highest quality textiles as is possible by said textile machine 118.

As noted above, in response to the controller 110 receiving a yarn tension signal (607) from yarn tension sensor 102, the controller 110 can perform operations to such that the yarn 104 has or maintains an appropriate or designated yarn tension set point (e.g., a target tension point) on the yarn feed side 114 of the yarn tension system 100. The operations performed by the controller 110 can include obtaining a tension signal from the tension sensor 102. Based on the tension signal generated by the yarn tension sensor 102, the controller 110 can perform certain operations of the self-synchronizing yarn tension system 100. These operations include obtaining a yarn tension signal from tension sensor 102, comparing the tension signal to the yarn tension range, determining whether the tension signal 607 is within the yarn tension range 606 (e.g., including whether the tension signal is equivalent to target tension point), generating one or more brake control signals 612 based on the determination whether the tension signal is within the yarn tension range 606 and operating the yarn brake 106 based on the one or more brake control signals. Tension signal 607 is indicative of the yarn tension measured by tension sensor 102 at sensor element 202. It should be appreciated that in exemplary embodiments with a combined tension sensor and movement sensor, the yarn tension signal may include a signal indicative of the yarn tension and/or may be equivalent to tension signal 607 (e.g., a movement signal indicating movement or yarn 104 at sensor element 202). For example, if based on the comparison, the controller 110 determines the yarn tension signal 607 is not within the yarn tension range 606, the controller 110 will perform further operations to include determining whether the yarn tension signal 607 is below the low-tension threshold 608, determining whether the yarn tension signal 607 meets the target tension point, and determining whether the yarn tension 607 signal exceeds the high-tension threshold 608. If the yarn tension signal 607 is below the low-tension threshold 608 or below target tension point, the controller 110 will generate a brake control signal 612 causing the yarn brake 106 to apply more pressure to the yarn 104 passing through the yarn brake 106, such that the tension on the yarn 104 increases at the yarn feed side 114 of the self-synchronizing yarn tension system 100. If the yarn tension signal 607 is above the high-tension threshold 610 or above target tension point, the controller 110 will generate a brake control signal 612 causing the brake 106 to release pressure from or reduce tension to the yarn 104 passing through the brake 106, such that the tension on the yarn 104 decreases at the yarn feed side 114 of the self-synchronizing yarn tension system 100. If based on the comparison of the tension signal 607 to the yarn tension range 606, the controller 110 determines that the tension signal 607 is within the yarn tension range 606, the controller 110 will generate a brake control signal 612 causing the brake 106 to maintain the position of the brake 106 or otherwise maintain the current pressure on the yarn 104 at the yarn feed side 114 of the self-synchronizing yarn tension system 100.

Brake control signal 612 can be based on predetermined braking increments for the operation of brake 106 stored in one or more memory devices 130 of the controller 110. The braking increments represent the amount of change of force or tension that brake 106 may apply to or release from brake 106 based on the brake control signal. For example, if the braking increment is 2 cN, the brake will open or close such that it applies force to the yarn so that the tension at the yarn feed side 114 of the self-synchronizing yarn tension system 100 is raised or lowered in increments of 2 cN. The braking increments can also be a percentage (e.g., usually between 1% and 20%) of the tension range that can be measured by yarn tension sensor 102. For example, if the yarn tension sensor 102 is capable of measuring a tension range of 0 cN to 1000 cN, the braking increments would be between 10 cN and 200 cN.

The braking increment can also be one or more increments entered in the controller 110 by a user or operator through a graphical user interface 120 or other input devices (e.g., keyboard, button, touch screen, etc.) that is part of or in communication with the controller 110 and stored in the one or more memory devices 130 of the controller 110. The braking increments can also be a plurality of stored and pre-determined values corresponding to certain types of yarn or the type of textile machine with which the self-synchronizing yarn tension system 100 is being used. For example, if a user indicates through an input entered in the controller 110 by a user or operator through a graphical user interface 120 or other input devices (e.g., keyboard, button, touch screen, etc.) that the yarn 104 is cotton, the controller will access the plurality of pre-determined and stored braking increments and utilize the braking increment associated with cotton yarns.

The self-synchronizing yarn tension system 100 can detect the non-operation of textile machine 118 based on yarn tension. If the yarn tension sensor 102 does not detect movement of the yarn 104 at sensing element 202 for more than one monitoring interval, the yarn tension sensor 102 can provide a stop signal to a controller 110. The non-movement signal or stop signal is indicative of the textile machine 118 being stopped or otherwise not in operation (e.g., yarn 104 is not moving in a lateral direction L from the yarn supply side 112 to the yarn feed side 114 of the self-synchronizing yarn tension system 100).

In response to the yarn tension signal 607 from yarn tension sensor 102 is indicative or no yarn movement, controller 110 can generate or transmit a stop signal 618. In response to the controller 110 generating a stop signal 618, the controller 110 can perform operations such as, generating an alarm signal 616. The alarm signal 616 can be a visual, auditory, or other type of indicator which informs a user or operator of an error in the operation of the textile machine 118. Such errors could include that the yarn 104 has broken, become improperly tensioned at the yarn feed side 114 of the self-synchronizing yarn tension system 100 and cannot be brought into the tension range based upon a pre-determined number of changes of the braking increment. The pre-determined number of occurrences of change of the braking increment can be a pre-determined threshold (e.g., 5 changes to the braking increment) stored in one or more memory devices 130.

In response to a stop signal 618, the controller 110 can perform other operations such as, setting the brake 106 to a predetermined position (i.e., operating brake 106 based on tension pulses) or deenergizing or turn-off elements of the self-synchronizing yarn tension system 100 which are not needed to allow yarn tension sensor 102 to monitor the yarn tension. For instance, the controller 110 can be deactivated or placed into a hibernation mode until it receives a tension signal (607) from yarn tension sensor 102. Thereafter, based on the tension signal (607), the controller 110 can activate or come out of hibernation and perform certain operations of the self-synchronizing yarn tension system 100 as described herein above.

Figure 2:
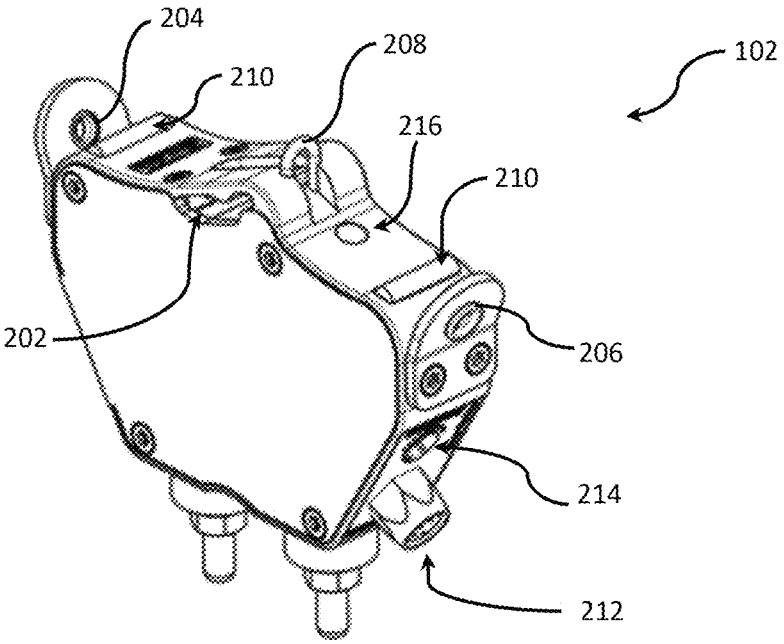
FIG. 2 depicts a partial perspective view of the yarn tension sensor of the self-synchronizing yarn tension system of FIG. 1.

FIG. 2 depicts a partial perspective view of the yarn tension sensor 102 of the self-synchronizing yarn tension system 100 of FIG. 1. Yarn tension sensor 102, includes a sensing element 202. Sensing element 202 detects movement and/or tension of yarn 104 which passes from the first eyelet 204 across sensing element 202 and through the yarn guide 208 and through second eyelet 206. Yarn tension sensor 102, includes one or more guide bars 210 to all the yarn 104 to angle across sensing element 202 at a predetermined angle. Guide bars 210 can be ceramic or another material which will not damage yarn 104 that is pulled or drawn across said guide bars 210. Yarn tension sensor 102, includes a communication port 212 at which one or more communication cables 124 can be connected to or in electrical communication with the yarn tension sensor 102. Yarn tension sensor 102, includes a potentiometer 214 which can be used to adjust or set the sensitivity of the sensing element 202. Yarn tension sensor 102, includes an indicator light 216 which can display different visual indicators reflecting the operational status of yarn tension sensor 102. For example, a steady green color of indicator light 216 means the sensor is ok and yarn tension signal is indicative of the yarn 104 not moving. If the indicator light 216 is not illuminated, it means the sensor is ok and yarn tension signal is indicative of the yarn 104 moving. If the indicator light 216 is flashing red the yarn tension sensor 102 has detected an error.

Figure 3:
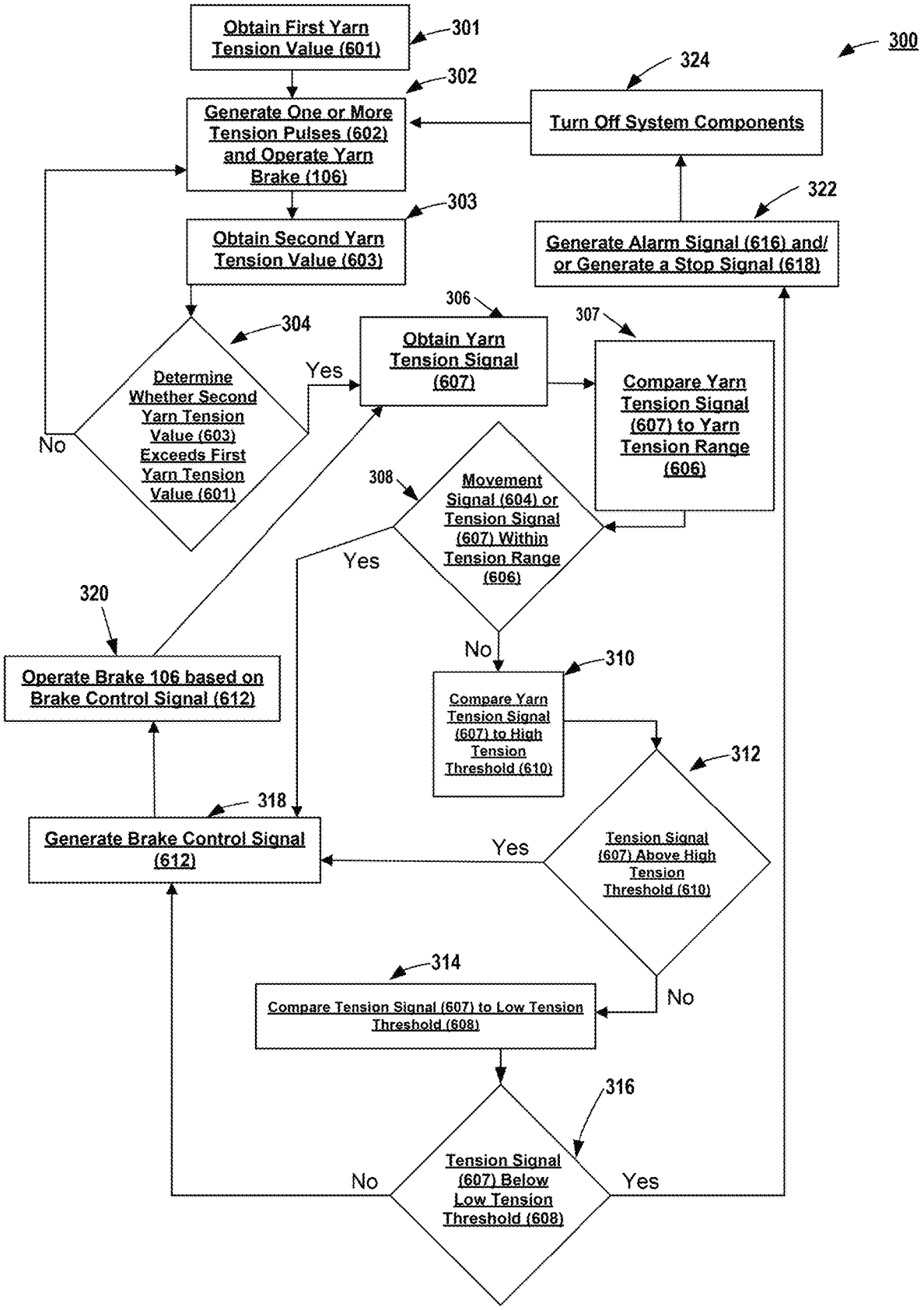
FIG. 3 depicts a flow diagram for a method for self-synchronizing yarn tension monitoring and control to facilitate necessary yarn tensioning on textile machines, but without connection to, interface with, or being in communication with the control unit of the textile machine according to example embodiments of the present disclosure.

FIG. 3 depicts a flow diagram 300 for a method for self-synchronizing yarn tension monitoring and control to facilitate necessary yarn tensioning on textile machines, but without connection to, interface with, or being in communication with the control unit of the textile machine, according to an example embodiment of the present disclosure.

One or more portion(s) of the method 300 can be implemented by a computing system that include one or more computing devices such as, for example, the computing systems described with reference to the other figures (e.g., controller 110, etc.). Each respective portion of the method 300 can be performed by any (or any combination) of one or more computing devices. Moreover, one or more portion(s) of the method 300 can be implemented as an algorithm on the hardware components of the device(s) described herein (e.g., as in FIG. 1), for example, to manage and administer a self-synchronizing yarn tension monitoring and control system. FIG. 3 depicts functions performed in a particular order for purposes of illustration and discussion. Those of ordinary skill in the art, using the disclosures provided herein, will understand that the elements of any of the methods discussed herein can be adapted, rearranged, expanded, omitted, combined, and/or modified in various ways without deviating from the scope of the present disclosure. FIG. 3 is described with reference to elements/terms described with respect to other systems and figures for exemplary illustrated purposes and is not meant to be limiting. One or more portions of method 300 can be performed additionally, or alternatively, by other systems.

At 301, the method 300 can include obtaining, by a controller 110, a first yarn tension value (601). First yarn tension value (601) can be a predetermined value stored in one or more memory devices 130 of the controller 110. For example, first yarn tension value could be about 0 to 5 cN or another tension mount entered in the controller 110 by a user or operator through a graphical user interface 120 (e.g., a touch screen) or other input devices (e.g., keyboard, buttons, etc.) that is part of or in communication with the controller 110 and said user input(s) are stored in the one or more memory devices 130 of the controller 110. In other embodiments, first yarn tension value could be the yarn 104 tension measured by tension sensor 102 by sensing element 202 of tension sensor 102 at a particular time (e.g., such as when system 100 is initially turned on).

At 302, the method 300 can include generating, by a controller 110, one or more tension pulses (602) and operating yarn brake (106) based on said one or more tension pulses. The one or more tension pulses (602) can be signals to control or dictate operation of yarn brake 106. For example, tension pulses (602) can be a predetermined or user selected increment of pressure or tension that the yarn brake 106 applies to the yarn 104 passing through yarn brake 106. The tension pulses can also be pre-determined values, stored or programmed into the one or more memory devices 130 by, e.g., the manufacturer of the self-synchronizing yarn tension system 100. For example, tension pulses could be of a predetermined value of 10 cN for a period of 10 milliseconds or any other values of force and time. Said tension pulses can be based on the type of yarn 104 or type of textile machine 118 with which the self-synchronizing yarn tension system 100 is being used. The tension pulses represent a specific amount of tension that is added or removed from the yarn 104 by the yarn brake 106, in order to detect a change in tension in the yarn 104 at the yarn feed side 114 of the self-synchronizing yarn tension system 100. The one or more processors 132 of controller 110 can store instructions that when executed by the one or more processors 132 to selectively operate the yarn brake 106 based on the one or more tension pulses (601).

At 303, the method 300 can include obtaining, by a controller 110, a second yarn tension value (603). The second yarn tension value (603) is obtained from and measured by tension sensor 102, specifically sensing element 202 of tension sensor 102, and represents the yarn 104 tension measured by tension sensor 102. At 303, the method can include controller 110 operates yarn brake 106 based on the one or more tension pulses (602).

At 304, the method 300 can include determining, by a controller 110, whether the second yarn tension value (603) exceeds first yarn tension value (601). If second yarn tension value (603) does not exceed first yarn tension value (601), method 300 retunes to 302. At 304, if second yarn tension value (603) is higher than first yarn tension value (601) the comparison is indicative of the textile machine 118 being in an operational state (i.e., the textile machine 118 is running and yarn 104 is moving in a lateral direction L from the yarn supply side 112 to the yarn feed side 114 of the self-synchronizing yarn tension system 100) and method 300 proceeds to 306. At 304, the method can include the controller 110 performing operations including ceasing operation of the yarn brake 106 based on the one or more tensioning pulses (602) when the second yarn tension (603) value exceeds the first yarn tension value (601).

At 306, the method 300 can include obtaining a yarn tension signal (607) from the yarn tension sensor 102. Yarn tension signal (607) represents the yarn 104 tension measured by tension sensor 102 by sensing element 202 of tension sensor 102 when the textile machine 118 is in an operational state (i.e., the textile machine 118 is running and yarn 104 is moving in a lateral direction L from the yarn supply side 112 to the yarn feed side 114 of the self-synchronizing yarn tension system 100).

At 307, method 300 can include comparing, by a controller 110, the yarn tension signal 607 to a yarn tension range 606 (or in some example embodiments a target tension point). A low-tension threshold 608 and a high-tension threshold 610 form the yarn tension range 606. The low-tension threshold 608 represents the least amount of tension that can be applied to yarn 104 located on the yarn feed side 114 of the self-synchronizing yarn tension system 100. The high-tension threshold 610 represents the highest amount of tension that can be applied to the yarn 104 located on the yarn feed side 114 of the self-synchronizing yarn tension system 100. In some embodiments, the high-tension threshold 610 can represent the amount of tension above which the yarn 104 is likely to break, fray or otherwise become damaged. The yarn tension range 606 represents a plurality of tension amounts or values representing the appropriate tension that must be maintained on the yarn 104 located on the yarn feed side 114 of the self-synchronizing yarn tension system 100, to allow for the yarn 104 that is fed into the textile machine 118 to be maintained at an appropriate tension to produce the most efficient and proper operation of the textile machine 118 and produce the highest quality textiles as is possible by said textile machine 118.

At 308, method 300 can include determining, by a controller 110, if the yarn tension signal 607 is within yarn tension range 606 based on the comparison at 307. If at 308, the yarn tension signal 607 is within yarn tension range 606, the method proceeds to 318. If at 308, the yarn tension signal 607 is determined not to be within the yarn tension range 606, the method proceeds to 310.

At 310, method 300 can include comparing, by a controller 110, the yarn tension signal 607 to the high-tension threshold 610.

At 312, method 300 can include determining, by a controller 110, whether the yarn tension signal 607 is above or more than the high-tension threshold 610. If at 312 the yarn tension signal 607 is more than the high-tension threshold 610, then method proceeds to 318. If at 312 the yarn tension signal 607 is not greater than the high-tension threshold 608, then method proceeds to 314.

At 314, method 300 can include comparing, by a controller 110, the yarn tension signal 607 to the low-tension threshold 608.

At 316, method 300 can include determining, by a controller 110, whether the yarn tension signal 607 is below or less than the low-tension threshold 608. If at 316 the yarn tension signal 607 is not less than the low-tension threshold 608, then method proceeds to 318. If at 316 the yarn tension signal 607 is less than the low-tension threshold 608, then method proceeds to 322 because an error has occurred during the performance of one or more of steps in method 300 or the textile machine 118 is no longer operational or operating properly.

At 318, method 300 can include generating, by the controller 110, a brake control signal 612 based, at least in part, on the comparison of the yarn tension signal 607 to the yarn tension range 606, the low-tension threshold 608 or the high tension threshold 610. If at 312 it is determined that the yarn tension signal 607 is above the high-tension threshold 610, at 318 the controller 110 will generate a brake control signal 612 which causes the brake 106 to release pressure from or reduce tension to the yarn 104 passing through the brake 106, such that the tension on the yarn 104 decreases at the yarn feed side 114 of the self-synchronizing yarn tension system 100. If at 308 it is determined based on the comparison of the yarn tension signal 607 (which can include a value or signal indicative of the pressure on the yarn 104 at the yarn feed side 114 of the self-synchronizing yarn tension system 100) to the yarn tension range 606, the controller 110 determines that the yarn tension signal 607 is within the yarn tension range 606, at 318 the controller 110 will generate a brake control signal 612 causing the brake 106 to maintain the position of the brake 106 or otherwise maintain the current pressure on the yarn 104 at the yarn feed side 114 of the self-synchronizing yarn tension system 100. If at 316 it is determined that the yarn tension signal 607 is below the low-tension threshold 608, the method proceeds to 322. After generation of brake control signal 612, method 300 proceeds to 320.

At 320, method 300 can include operating the brake 106 based on the brake control signal 612. Brake control signal 612 can be based on predetermined braking increments for the operation of brake 106 stored in one or more memory devices 130 of the controller 110. The braking increments represent the amount of change of force that brake 106 may apply to or release from brake 106 based on the brake control signal. For example, if the braking increment is 2 cN, the brake 106 will open or close such that it applies force to the yarn 104 so that the tension at the yarn feed side 114 of the self-synchronizing yarn tension system 100 is raised or lowered in increments of 2 cN. The braking increments can also be a percentage (e.g., usually between 1% and 20%) of the tension range 606 that can be measured by yarn tension sensor 102. For example, if the tension sensor 102 is capable of measuring a tension range of 0 cN to 1000 cN, the braking increments would be between 10 cN and 200 cN. After 320, method 300 returns to 306.

At 322, the method can include generating, by the controller 110, a non-movement signal or stop signal 618. The non-movement signal or stop signal 618 is indicative of the textile machine 118 being stopped or otherwise not in operation (e.g., yarn 104 is not moving in a lateral direction L from the yarn supply side 112 to the yarn feed side 114 of the self-synchronizing yarn tension system 100) or the stop signal 618 can indicate the textile machine 118 is not in a state of proper operation. After generation of the stop signal 618, the method proceeds to 324.

At 324, the method 300 can include in response to stop signal 618 controller 110 can perform operations such as setting the brake 106 to a predetermined or resting position (such as returning to step 302 and operating the yarn brake 106 based on one or more tension pulses 602) or deenergizing or turn-off elements of the self-synchronizing yarn tension system 100 which are not needed to allow the brake 106 to operate based on the tension pulses 602 and allow yarn tension sensor 102 to monitor the yarn tension obtaining a tension signal from the tension 102. After 324 method 300 returns to 302.

Although specific features of various embodiments may be shown in some drawings and not in others, this is for convenience only. In accordance with the principles of the present disclosure, any feature of a drawing can be referenced and/or claimed in combination with any feature of any other drawing.

This written description uses examples for the disclosure, including the best mode, and also to enable any person skilled in the art to practice the disclosure, including making and using any devices or systems and performing any incorporated methods. The patentable scope of the disclosure is defined by the claims, and can include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A self-synchronizing yarn tension system, the system comprising:

a yarn tension sensor;

a yarn brake; and a controller configured to control the system, wherein the controller includes, one or more processors and one or more memory devices, the one or more memory devices configured to store one or more tension pulses, store one or more tension thresholds, and store instructions that when executed by the one or more processors cause the one or more processors to perform operations, the operations comprising:

obtaining a first yarn tension value;

operating the yarn brake based on the one or more tension pulses;

obtaining a second yarn tension value by the operating the yarn brake based on the one or more tension pulses;

determining whether the first tension value exceeds the second tension value;

obtaining a yarn tension signal from the yarn tension sensor;

comparing the yarn tension signal to the one or more tension thresholds;

generating one or more brake control signals based on said comparing of the yarn tension signal to the one or more tension thresholds; and operating the yarn brake based upon each of the one or more brake signals.

2. The self-synchronizing yarn tension system of claim 1, wherein the controller is not in communication with the textile machine.

3. The self-synchronizing yarn tension system of claim 2, wherein the one or more tension thresholds comprise a high tension threshold and a low tension threshold.

4. The self-synchronizing yarn tension system of claim 3, wherein the high tension threshold and low tension threshold define a tension range.

5. The self-synchronizing yarn tension system of claim 4, wherein the comparing the yarn tension signal to the one or more tension thresholds further comprises:

comparing yarn tension signal to the tension range;

comparing yarn tension signal to the low tension threshold; and comparing yarn tension signal to the high tension threshold.

6. The self-synchronizing yarn tension system of claim 5, wherein if the controller determines the textile machine is not operational based on the yarn tension signal, the operations performed by the one or more processors further comprise:

generating a stop signal;

generating an alarm signal; and operating the controller and the yarn brake based on the stop signal and the one or more tension pulses.

7. The self-synchronizing yarn tension system of claim 6, wherein operating the yarn brake based upon each of the one or more brake signals further comprises:

decreasing the yarn brake pressure, based on a braking increment, in response to determining the yarn tension signal is above the high-tension threshold; and operating the yarn brake based on the one or more tension pulses, in response to determining the yarn tension signal is below the low-tension threshold.

8. The self-synchronizing yarn tension system of claim 7, wherein the braking increment is based, at least in part, on a type of yarn being utilized by the textile machine.

9. A method for controlling self-synchronizing yarn tension system, wherein the system comprises one or more controllers, a yarn tension sensor, and a yarn brake, the method comprising:

obtaining a first yarn tension value;

operating the yarn brake based on the one or more tension pulses;

obtaining a second yarn tension value by the operating the yarn brake based on the one or more tension pulses;

determining whether the first tension value exceeds the second tension value;

obtaining a yarn tension signal from the yarn tension sensor;

comparing the yarn tension signal to the one or more tension thresholds;

generating one or more brake control signals based on said comparing of the yarn tension signal to the one or more tension thresholds; and operating the yarn brake based upon each of the one or more brake signals.

10. The method of claim 9, wherein the one or more tension thresholds comprise a high tension threshold and a low tension threshold and, wherein the high tension threshold and low tension threshold define a tension range.

11. The method of claim 10, wherein the method further comprises:

comparing the yarn tension signal to the tension range;

comparing the yarn tension signal to the low tension threshold; and comparing the yarn tension signal to the high tension threshold.

12. The method of claim 11, wherein in response to determining the textile machine is not operational, the method further comprises:

generating a stop signal;

generating an alarm signal; and operating the controller and the yarn brake based on the stop signal and the one or more tension pulses.

13. The method of claim 12, wherein the method further comprises:

decreasing the yarn brake pressure, based on a braking increment, in response to determining the yarn tension signal is above the high-tension threshold; and operating the yarn brake based on the one or more tension pulses, in response to determining the yarn tension signal is below the low-tension threshold.

14. The method of claim 13, wherein the braking increment is based, at least in part, on a type of yarn being utilized by the textile machine.

15. The method of claim 9, wherein the tension pulses are based, at least in part, on a type of yarn being utilized by the textile machine.

* * * * *